US005252197A

United States Patent [19]

Alexander et al.

[11] Patent Number: 5,252,197

[45] Date of Patent: Oct. 12, 1993

[54] PROCESS FOR UPGRADING GASOLINES AND OTHER HYDROCARBON MIXTURES

[75] Inventors: Anatoly Alexander, Berkeley Heights; Chuen Y. Yeh, Edison; George D. Suciu, Ridgewood, all of N.J.

[73] Assignee: ABB Lummus Crest Inc., Bloomfield, N.J.

[21] Appl. No.: 952,352

[22] Filed: Sep. 28, 1992

[51] Int. Cl.[5] ..... C10G 35/04

[52] U.S. Cl. ..... 208/134; 208/135; 585/475; 585/467; 585/653; 585/739

[58] Field of Search ..... 208/134, 135; 585/467, 585/475, 653, 739

[56] References Cited

U.S. PATENT DOCUMENTS

| | | | |
|---|---|---|---|
| 2,904,607 | 9/1959 | Mattox et al. | 585/323 |
| 4,127,471 | 11/1978 | Suggitt et al. | 208/135 |
| 4,891,458 | 1/1990 | Innes et al. | 585/323 |
| 5,053,573 | 10/1991 | Jorgensen et al. | 208/135 |
| 5,087,784 | 2/1992 | Primack et al. | 585/446 |
| 5,146,034 | 9/1992 | Morales et al. | 208/135 |
| 5,178,748 | 1/1993 | Casci et al. | 208/135 |

FOREIGN PATENT DOCUMENTS

| | | | |
|---|---|---|---|
| 2640994 | 12/1988 | France | 585/446 |

OTHER PUBLICATIONS

A. P. Bolton, Molecular Sieve Zeolites, 1976, pp. 1-8

Julius Scherzer, Octane-Enhancing Zeolite FCC Catalysts pp. 111-115.

J. M. Newsam, et al., Structural Characterization of Zeolite Beta, Apr. 14, 1988, Proc. R. Soc. Lond. A420 pp. 375-377.

J. Biswas, et al., Recent Process—and Catalyst-Related Developments in Fluid Catalytic Cracking, Applied Catalysis.

*Primary Examiner*—James H. Reamer

*Attorney, Agent, or Firm*—Chilton, Alix & Van Kirk

[57] ABSTRACT

A process for upgrading gasolines and other hydrocarbon mixtures. The hydrocarbon mixture is contacted with a large pore zeolite catalyst in order to crack n-paraffins to form olefins and lower molecular weight n-paraffins, to cause the olefins to react with benzene in order to form alkylbenzenes, and to catalyze the isomerization of the n-paraffins to form i-paraffins. Preferably, all of the above reactions occur in a single reactant mixture in the presence of a zeolite catalyst having ten and/or twelve membered ring-type structures. The process of the invention reduces the benzene quantity of the hydrocarbon mixture and increases its octane number.

27 Claims, 1 Drawing Sheet

PROCESS FOR UPGRADING GASOLINES AND OTHER HYDROCARBON MIXTURES

BACKGROUND OF THE INVENTION

The present invention relates to a process for upgrading hydrocarbon mixtures such as gasolines. More particularly, the invention relates to a process for decreasing the quantity of potentially harmful substances, such as benzene, in a hydrocarbon mixture while increasing the octane rating of the mixture.

In the petroleum industry, environmental and health considerations are leading to changes in processes for refining and/or reformulating gasoline. The use of leaded compounds in gasoline in order to boost its octane rating has been substantially discontinued, and economical alternatives for boosting the octane rating of gasoline are therefore needed. Furthermore, newly emerging regulations relating to automobile fuel emissions have prompted efforts to develop an economical process for reducing the content of benzene in gasoline.

In conventional petroleum processing, catalytically reformed naphtha is a major component of the total gasoline pool. Catalytically reformed naphtha also is the primary source of benzene in automotive fuels. Thus, a reduction in the benzene content of naptha reformate would contribute substantially to a reduction in the benzene content of a gasoline blend.

A variety of chemical reactions occur in the reforming of naphtha. These include dehydroaromatization of naphthenes, dehydrocyclization of paraffins, isomerization of paraffins, hydrocracking of paraffins and naphthenes, and hydrodealkylation of aromatics. The drawback of such processes is that they result in the production of a substantial quantity of n-paraffins, thereby lowering the octane rating of the reformate. The ratio of octane-reducing n-paraffins to octane-boosting i-paraffins in the reformate depends upon equilibrium at the reaction temperature. An increase in reforming temperature leads to an increased amount of n-paraffins.

Conventional processes for upgrading gasolines attempt to separately solve the problems of the presence of benzene and the presence of n-paraffins in reformate. In general, known processes for decreasing the amount of n-paraffins in gasoline-type feedstocks involve either isomerization of n-paraffins at moderate temperatures to shift equilibrium, or selective cracking of n-paraffins into liquefied petroleum gas (LPG) components at temperatures over 300°–400° C., particularly over zeolite A or erionite-type materials. The narrow pores of these zeolites do not allow any molecules other than n-paraffins to enter, and thus only n-paraffins are subject to cracking using such zeolites. Furthermore, these methods result in a decrease in the overall yield of gasoline product, because a portion of the feed is converted to LPG compounds.

Several techniques have been suggested for lowering the benzene concentration of reformate. These techniques generally involve either changing reforming feed or conditions, extracting aromatics, or alkylating aromatics with olefins. When the reforming feed or conditions are changed, a significant loss in the amount of feedstocks available for gasoline blending usually results. Extraction of the aromatics has limited economic viability, and is useful only in plants in which benzene can be used or from which it can be sold in the marketplace. Alkylation of aromatics has been conducted in various ways, including by using zeolite catalysts, as disclosed in U.S. Pat. Nos. 5,087,784 and 2,904,607. Another method which is known for alkylating aromatics involves predistillation of the reformate, followed by alkylation of its light fraction containing benzene with the addition of olefins, particularly propylene, over a fixed bed of solid phosphoric acid catalyst. Following alkylation, the light fraction is stabilized and then blended with the resulting product. Yet another alkylation method, which is disclosed in French Patent 2,640,994, involves fractionating reformate and contacting it with olefins over mordenite-type zeolite in order to reduce the benzene content of the reformate. However, in at least the latter two methods for alkylating aromatics, the rate of conversion of benzene to alkylbenzene is generally quite low. Furthermore, none of the known techniques for benzene alkylation also provide for isomerization of n-paraffins in order to further increase the octane rating of the reformate.

SUMMARY OF THE INVENTION

An object of the invention is to provide an efficient process for obtaining a high quality gasoline component from naphtha reformate.

Another object of the invention is to provide a process for reducing the benzene content of a hydrocarbon mixture while simultaneously converting n-paraffins to i-paraffins.

Another object of the invention is to provide a process for reducing the content of harmful substances in a hydrocarbon mixture using a catalyst which can be regenerated in a highly efficient manner.

A further object of the invention is to reduce the benzene content of a hydrocarbon mixture while simultaneously increasing the octane number of the mixture.

Yet another object of the invention is to increase the octane number of naphtha reformate without increasing reforming severity.

These and other objects will be in part obvious and in part pointed out more in detail hereinafter.

The invention in a preferred form is a process for reducing quantities of benzene and n-paraffins present in a hydrocarbon mixture. The process comprises contacting the hydrocarbon mixture with an appropriate concentration of a zeolite catalyst at conditions of temperature and pressure which are suitable to crack n-paraffins to form olefins and lower molecular weight n-paraffins, to cause olefins to react with benzene in order to form alkylbenzenes, and to promote isomerization of n-paraffins to form i-paraffins. Preferably, the process also comprises the step of contacting the alkylbenzenes with a transalkylation catalyst in order to convert polyalkylbenzenes, such as dialkylbenzenes and trialkylbenzenes, to monoalkylbenzenes. In a particularly preferred embodiment, the transalkylation catalyst is the same catalyst as is used for cracking, alkylation, and isomerization. Preferred catalysts for alkylation, cracking, isomerization and transalkylation include zeolites having ten or twelve membered ring-type structures, such as faujasite, type Y, zeolite omega, ZSM-12, zeolite beta, and zeolite containing FCC catalysts. The process of the invention is particularly useful in order to reduce the quantity of benzene in a gasoline pool component while simultaneously increasing the octane rating of the component.

In a particularly preferred embodiment of the invention, an olefin is added to the hydrocarbon mixture of the process described in a (benzene+toluene):olefin molar ratio of about 0:5:1 to 10:1, or more preferably 1:1 to 3:1, to alkylate benzene, thereby resulting in a greater degree of benzene alkylation. Particularly preferred olefins include ethylene and propylene.

Another embodiment of the invention is a process for reducing the quantities of benzene and n-paraffins in a hydrocarbon mixture using a zeolite FCC catalyst which is regenerated in a highly efficient manner. The process comprises contacting the hydrocarbon mixture with an appropriate concentration of a zeolite containing FCC catalyst at conditions of temperature and pressure sufficient to crack the n-paraffins to form olefins and lower molecular weight n-paraffins, and to induce reaction of the olefins with benzene to form alkylbenzenes. The FCC catalyst is regenerated in a catalyst regenerator which is shared with another reactor which is used as part of a hydrocarbon mixture production process, such as a catalytic cracking vessel. Preferably, the process of this embodiment of the invention further comprises the step of isomerizing n-paraffins to form i-paraffins, preferably using the same catalyst as is used for cracking and alkylation. The process also preferably includes the step of transalkylating polyalkylbenzenes formed in the alkylation process to form monoalkylbenzenes.

The invention accordingly comprises the steps and the relation of one or more of such steps with respect to each of the others, and the relation of elements exemplified in the following detailed disclosure.

DETAILED DESCRIPTION OF THE INVENTION

Figure 1:
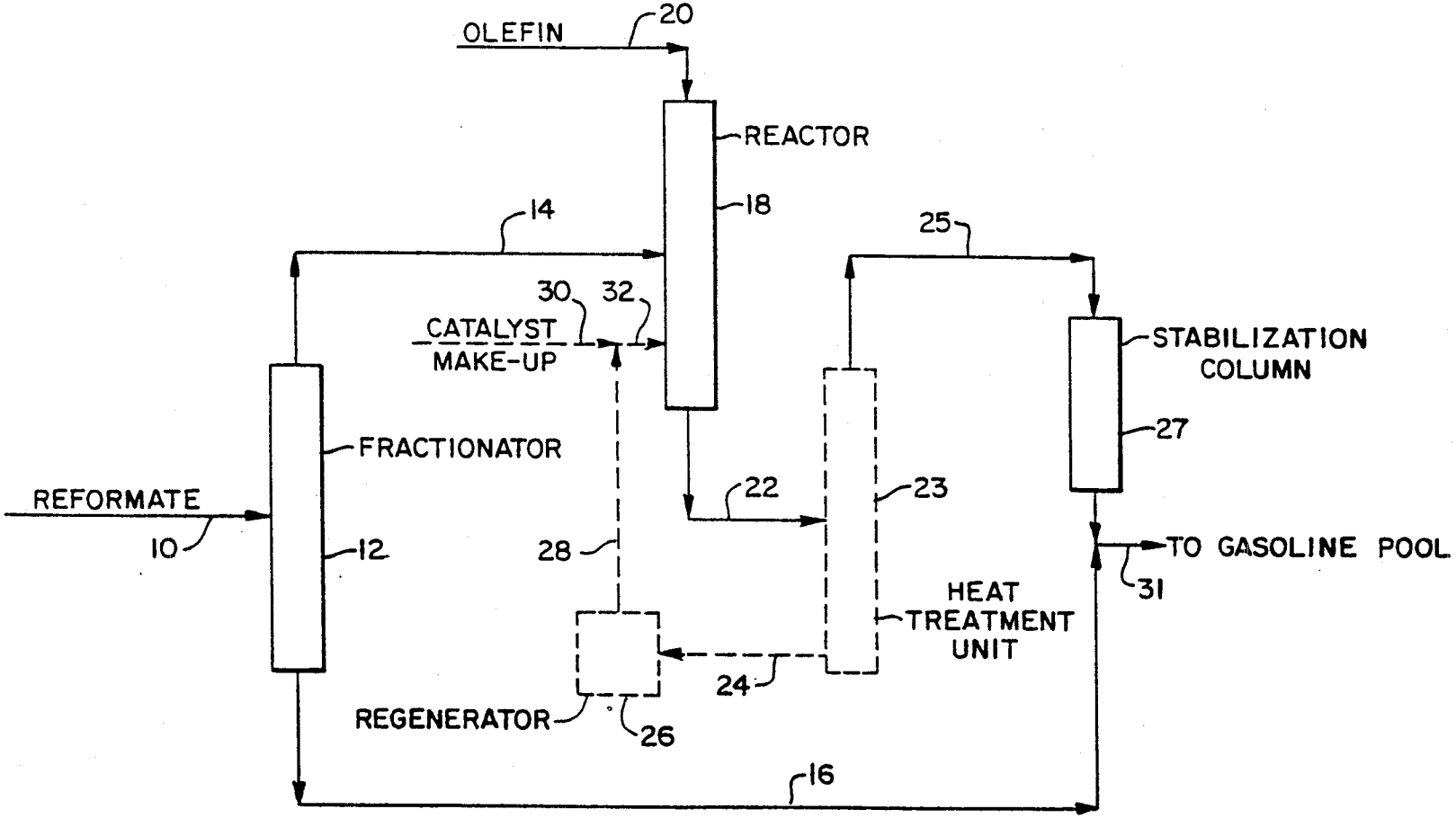
FIG. 1 is a flow diagram for a process for reducing the content of benzene and n-paraffins in reformate using zeolite containing FCC catalyst according to a preferred embodiment of the invention.

The invention is a process which achieves reduction of the quantity of benzenes and n-paraffins in a hydrocarbon mixture by polyfunctional catalysis. The process is particularly well-suited for treating a benzene-rich cut of naphtha reformate. However, hydrocarbon mixtures containing materials such as xylenes, toluenes, alkylated benzenes and alkylated toluenes also can be treated according to the invention.

The process of the invention involves the step of cracking n-paraffins which are present in a hydrocarbon mixture. As a result of the cracking step, the intermediate mixture contains low molecular weight olefins and paraffins, as well as various cracking intermediates. The benzene which is present in the hydrocarbon mixture is alkylated by the olefins and in certain cases by other cracking intermediates. Optionally, olefins are added to the hydrocarbon mixture to commence and/or increase the rate of benzene alkylation. Cracking and alkylation occur in the presence of a slurry of a polyfunctional, acidic cracking and alkylation catalyst. Cracking and alkylation are followed by the step of isomerizing n-paraffins which are present in the reactor feed stream as well as n-paraffins which are formed during the cracking process. Alternatively, cracking, alkylation and isomerization take place in a single mixture in the presence of a polyfunctional, acidic cracking, alkylation and isomerization catalyst.

According to a preferred embodiment of the invention, the process further includes the step of converting polyalkylbenzenes to monoalkylbenzenes by reacting them with unreacted benzene. This transalkylation reaction, which is desirable in order to keep the boiling range of the reformate within the desired temperature interval, occurs in the presence of a transalkylation catalyst. The transalkylation catalyst can be the same as the alkylation catalyst.

Chemical reactions taking place according to a preferred embodiment of the present invention can be illustrated by the following exemplary equations:

| | | |
|---|---|---|
| (1) | cracking and alkylation | $n\text{-}C_7H_{16} \rightarrow [C_2H_4] + n\text{-}C_5H_{12}$ |
| | | $[C_2H_4] + C_6H_6 \rightarrow C_2H_5C_6H_5$ |
| | | $C_2H_5C_6H_5 + C_2H_4 \rightarrow (C_2H_5)_2C_6H_4$ |
| (2) | transalkylation | $C_6H_6 + (C_2H_5)_2C_6H_4 \rightarrow 2\ C_2H_5C_6H_5$ |
| (3) | isomerization | $n\text{-}C_5H_{12} \rightarrow i\text{-}C_5H_{12}$. |

With reference to equations (1)–(3), the process of the present invention is implemented by contacting a hydrocarbon mixture, such as the benzene-containing fore-cut of reformate distillation, at a temperature of about 200°–600° F. and a pressure sufficient to keep the reactant in a liquid phase, with a large pore heterogeneous zeolite catalyst.

Preferred catalysts for the process of the invention are molecular sieve zeolites having 10- or 12-membered ring-type structures, including faujasite, type Y, zeolite omega, ZSM-12, zeolite beta, and zeolite containing fluidized bed catalytic cracking (FCC) catalysts such as those which are described in Biswas, J. et al., "Recent Process- and Catalyst-Related Developments in Fluid Catalytic Cracking," *Applied Catalysis,* 63 (1990) 207–255, the contents of which are incorporated herein by reference, including FCC catalysts containing zeolite Y. Some non-limiting examples of commercially available FCC catalysts are Super-D, Octacat, GX, GXO-40, GX0-25, DXB, DA, and XP (W. R. Grace); Octavision, Action, and Vision (AKZO Chemie); and Octidyne, Nitrodyne, Dynasiv, Monadyne, and Ultradyne (Engelhard). The catalyst or catalysts can be in a fixed, fluid or ebullated bed. Preferably, the catalyst is in the form of small particles in a slurry of the reaction mixture having a particle size below about 100–200 microns and a pore diameter which is large enough to permit the passage of benzene and toluene. For example, faujasite, a zeolite having a pore diameter of about 0.9 nm, can be used. FCC catalysts are preferred for economic reasons, as they can be regenerated in a regenerator which also is used to regenerate catalyst used in other cracking processes at the same facility.

The reactions (1)–(3) shown above can take place in one or in several reaction zones under similar or different conditions. When a single reaction zone is used, a polyfunctional catalyst is used to effect reaction. When each reaction or set of reactions takes place in a different zone, the same polyfunctional catalyst can be used for each reaction and can be transferred together with the reaction mixture, or a different catalyst can be used in each zone. When different zones are used, the reaction conditions of temperature, pressure, and hydrocarbon:catalyst ratio can be determined separately for each zone by techniques which are known to one having ordinary skill in the art. In general, each reaction preferably will have a temperature of 200°–600° F. and a pressure of 50–1000 p.s.i.g.

If an olefin is added to alkylate benzene, it preferably is ethylene or propylene. However other olefins which will alkylate benzene also can be used.

Referring to FIG. 1, a process flow diagram for a preferred process for alkylation of a benzene-rich cut of reformate using a FCC catalyst is illustrated. Naptha reformate is introduced through line 10 into a fractionator 12 in which a benzene-rich stream is removed in line 14 from the top and a heavy reformate stream is removed in line 16 from the bottom. The heavy reformate stream in line 16 is sent directly to a gasoline pool. The benzene-rich stream in line 14 is fed to a reactor 18 containing a polyfunctional alkylation, isomerization and cracking zeolite FCC catalyst. Olefins are optionally added to the reactor through line 20 in order to alkylate the benzene which is present therein. The reaction products, unreacted materials and reaction by-products are removed from reactor 18 in line 22 and are fed to a heat treatment unit 23 in which additional cracking, isomerization, transalkylation and/or alkylation with cracking products takes place. The heat treated product stream is removed in line 25 and transferred to stabilization column 27, in which light cracking products generated in the reactor 18 and heat treatment unit 23, and propane or other low molecular weight alkanes added with the olefins in line 20 are removed. The effluent from stabilization column 27 is removed, combined with the heavy reformate stream in line 16 and transferred to the gasoline pool through line 31, or otherwise is used directly for gasoline blend.

The catalyst material which is used in the reactor 18 and is transferred in line 22 to heat treatment unit 23 concurrently with the product stream is removed from the heat treatment unit 23 in line 24 and is introduced into a catalyst regenerator 26. Regenerated catalyst is removed from the regenerator 26 in line 28 and is combined with fresh catalyst from line 30 in line 32, which is then introduced into the reactor 18. As an alternative, the regenerated catalyst is sent to a FCC unit for use in cracking and fresh catalyst is conveyed to reactor 18.

According to the preferred embodiment illustrated in FIG. 1, the fractionator 12 is operated at, e.g., a temperature of about 120°-160° F. and at about atmospheric pressure. The number of plates in the fractionator and the reflux ratio can be determined by one of ordinary skill in the art. The reactor 18 preferably contains about 0.1-20 wt % of catalyst based upon the total weight of reactants present in the reactor at a single time. Reaction occurs at a temperature of about 200°-600° F. or more preferably about 300°-500° F. and a pressure of about 50-200 psig for a residence time of 0.1-1000 minutes. The heat treatment unit 23 preferably is operated at a temperature of about 200°-600° F. and a pressure of about 50-1000 p.s.i.

Regeneration of the catalyst can occur in a manner that is well known in the art, such as is described in P. B. Venuto & E. T. Thomas Habib, Jr., *Fluid Catalytic Cracking With Zeolite Catalysts,* Marcel Dekkar, Inc. (1979) pp. 16-19, 81-92, the contents of which are incorporated herein by reference. Olefin is fed to the reactor 18 at a rate of 0.1-1.5 mole of olefin per mole of (benzene+toluene) present in the benzene-rich cut of reformate.

The process is essentially the same when other catalysts are used, except that when catalysts such as zeolite beta are used, heat treatment unit 23 is not required.

Having generally described the invention, the following examples are included for purposes of illustration so that the invention may be more readily understood and are in no way intended to limit the scope of the invention.

EXAMPLE 1

Twenty grams of FCC catalyst Octidyne 1170 (Engelhard Corp.) and 185 g of a benzene-rich cut of reformate from naptha were placed into an autoclave. The autoclave was sealed and maintained for six hours at 430° F. and 650 p.s.i.g. with continuous stirring. The autoclave was cooled to a temperature sufficiently cool to enable the autoclave to be handled, e.g. about ambient temperature, and the contents were removed. Samples of the reactor feed and product were analyzed by gas chromatography. Data showing the concentration of certain components in the reactor feed and effluent is provided in Table 1.

TABLE 1

Content of Selected Hydrocarbons in the Reactor Feed and Effluent

| Component | Feed, wt % | Effluent, wt % |
|---|---|---|
| Isobutane | 0.04 | 0.89 |
| n-Butane | 1.15 | 1.29 |
| i-Pentane | 9.76 | 10.77 |
| n-Pentane | 8.68 | 8.34 |
| n-Hexane | 8.35 | 7.24 |
| Benzene | 15.45 | 11.07 |
| n-Heptane | 5.11 | 4.23 |
| Toluene | 11.77 | 8.71 |
| Ethylbenzene | trace | 1.22 |
| Xylenes | — | 1.90 |
| Cumene | — | 0.33 |
| Other $C_9$ arom. | — | 3.13 |
| $C_{10}$ arom. | — | 1.31 |
| $C_{11}$ arom. | — | 0.67 |
| $C_{12}$+ arom. | — | 0.54 |

The concentrations of n-hexane and n-heptane decreased by 13.3% and 17.2%, respectively, due to cracking. The concentration of i-pentane increased by 10.3%. The benzene and toluene concentrations were reduced by 28.3% and 26.0%, respectively. The cracking intermediates were either consumed in alkylation of benzene and/or toluene or were isomerized to lower molecular weight isoparaffins, such as i-butane.

EXAMPLE 2

Twenty grams of FCC catalyst Octidyne 1170 (Engelhard Corp.) and 185 g of benzene-rich cut of reformate from naptha from the same source as was used in Example 1 were placed in an autoclave, which was then sealed. The autoclave was brought to a temperature of 365° F. and a pressure of 650 psig. After a temperature of 365° was reached, 40 g of a synthetic $C_3$ blend cut containing 40 wt % propylene and 60 wt % propane, mixed in the lab, was added to the autoclave slowly over a 25 minute period. The temperature of the autoclave was then increased to 430° F. and a pressure of 850 psig and was maintained at this level for six hours. After cooling to ambient temperature, the autoclave was unloaded. Samples of the reactor feed and effluent were depropanized and then analyzed by gas chromatography. Data showing the concentration of certain components in the reactor feed and effluent is provided in Table 2. The composition of the effluent is shown both in terms of overall composition and the composition when the increase in the overall weight of the effluent due to the addition of propylene and propane is not included.

TABLE 2

| Component | Content of Selected Hydrocarbons in Reactor Feed and Effluent: Feed, wt % | Effluent, wt % | Effluent, wt % recalculated for initial charge weight |
|---|---|---|---|
| i-Pentane | 9.76 | 9.57 | 10.40 |
| n-Pentane | 8.68 | 7.18 | 7.80 |
| n-Hexane | 8.35 | 7.26 | 7.89 |
| Benzene | 15.45 | 2.93 | 3.18 |
| n-Heptane | 5.11 | 4.65 | 5.05 |
| Toluene | 11.77 | 4.35 | 4.73 |
| Ethylbenzene | trace | 0.24 | 0.26 |
| Xylenes | — | 0.47 | 0.51 |
| Cumene | — | 9.94 | 10.80 |
| $C_{10}$ arom. | — | 7.59 | 8.25 |
| $C_{11}$ arom. | — | 0.47 | 0.51 |
| $C_{12}$ arom. | — | 7.52 | 8.17 |
| $C_{13}$+ arom. | — | 1.79 | 1.94 |

When propylene was added as a alkylation agent, the conversion of benzene and was significantly higher than in Example 1. Benzene was converted at a rate of 79.4%, and toluene conversion was 59.8%. The conversion of n-hexane was 5.5%, and the concentration of i-pentane increased by 6.6%.

EXAMPLE 3

Twenty grams of FCC catalyst Octidyne 1170 (Engelhard Corp.) and 185 g of a benzene-rich cut of a reformate of naphtha were placed in an autoclave. The reformate was of different origin than the reformate used in Examples 1 and 2. The autoclave was sealed and brought to a temperature of 365° F. and a pressure of 650 psig. Subsequently, 40 g of synthetic $C_3$ blend cut containing 40 wt % propylene and 60 wt % propane, mixed in the lab, was added over a 25 minute period. After all of the $C_3$ cut was added, the autoclave was heated to a temperature of 480° F. and brought to a pressure of 900 psig, and was maintained at these conditions for six hours. After cooling to ambient temperature, the autoclave was unloaded. Samples of the reactor feed and effluent were analyzed by gas chromatography. Data showing the concentration of certain components of the reactor feed and effluent is shown on Table 3.

TABLE 3

| Component | Content of Selected Hydrocarbons in the Reactor Feed and Effluent: Feed, wt % | Effluent, wt % | Effluent, wt % recalculated for initial charge weight |
|---|---|---|---|
| n-Pentane | 12.99 | 11.29 | 12.27 |
| Benzene | 13.72 | 2.69 | 2.92 |
| Toluene | 4.12 | 1.33 | 1.45 |
| Ethylbenzene | trace | 0.13 | 0.14 |
| Xylenes | — | 0.17 | 0.18 |
| Cumene | — | 7.19 | 7.81 |
| $C_{10}$ arom. | — | 2.64 | 2.87 |
| $C_{11}$ arom. | — | 0.36 | 0.39 |
| $C_{12}$ arom. | — | 6.68 | 7.26 |
| $C_{13}$+ arom. | — | 1.63 | 1.77 |

The overall conversion of benzene was 78.7%, which is comparable to the conversion obtained in Example 2. The conversion of toluene was 64.8%. Thus, the use of a small amount of catalyst at appropriate reaction temperatures and pressures, as used in Example 3, is sufficient to achieve a high rate of benzene conversion.

EXAMPLE 4

Two hundred grams of a benzene-rich reformate distillate having the composition indicated in Table 4 was contacted with 56 g of propane/propylene blend (50 wt % propylene) in the presence of 2 wt % FCC catalyst, Octidyne 1170 (Engelhard Corp.), for two hours at 185° C. and a pressure of 400 p.s.i.g. The post reaction composition is shown on Table 4. The process was repeated with a fresh sample of reformate distillate, with the exception that the reaction took place at 220° C. and transalkylation followed the process.

Similar experiments were conducted using zeolite beta, Valfor C-811-25 and Valfor C-811-75 (PQ Corp.) for the reaction times and at the temperatures shown on Table 4. The composition of the product stream and the amounts of benzene and toluene conversion are shown in Table 4.

TABLE 4

COMPARISON OF RESULTS OF REFORMATE ALKYLATION OVER FCC CATALYST AND ZEOLITE BETA

| Parameters | Initial | FCC (Octidyne 1170): Alkylation only 2 hrs, 185 C. | FCC (Octidyne 1170): Same + transalkylation 2 hrs, 220 C. | ZEOLITE BETA (Si/Al = 25) (Valfor C-811-25): 205° C./2 hrs | ZEOLITE BETA (Si/Al = 25) (Valfor C-811-25): 205° C./0.5 hr | Zeolite Beta (Si/Al = 75) (Valfor C-811-75) 205° C./0.5 hr |
|---|---|---|---|---|---|---|
| Composition, wt % | | | | | | |
| Lights | 58.4 | 52.4 | 53.1 | 52.2 | 54.3 | 53.5 |
| Benzene | 16.0 | 5.8 | 3.7 | 3.7 | 3.3 | 3.7 |
| Interm. ft. | 13.6 | 12.1 | 12.2 | 12.4 | 13.2 | 12.7 |
| Toluene | 11.8 | 3.7 | 4.8 | 5.0 | 4.4 | 3.8 |
| Heavy paraf. | 0.1 | 0.1 | 0.2 | 0.1 | 0.1 | 0.1 |
| EB | | 0.0 | 0.1 | 0.0 | 0.0 | 0.0 |
| m- + p-Xylene | | 0.1 | 0.2 | 0.1 | 0.0 | 0.0 |
| o-Xylene | | 0.0 | 0.1 | 0.0 | 0.0 | 0.0 |
| C9 Arom. | | 7.2 | 10.0 | 10.2 | 8.9 | 8.3 |
| C10 Arom. | | 7.1 | 6.3 | 6.8 | 6.3 | 6.8 |
| C11 Arom. | | 0.2 | 0.4 | 0.2 | 0.2 | 0.1 |
| C12 Arom. | | 7.2 | 6.8 | 6.8 | 7.0 | 8.4 |
| C13+ Arom. | | 4.0 | 2.0 | 2.4 | 2.2 | 2.5 |
| Benzene conversion, % | | 59.0 | 73.5 | 73.4 | 76.6 | 73.4 |
| Toluene conversion, % | | 63.7 | 52.9 | 50.9 | 56.8 | 62.7 |

The "intermediate fraction," listed as the third component on Table 4, contains mostly $C_7$ paraffins and naphthenes, including heptane, methylhexanes, methylcyclohexane, dimethylcyclopentanes, etc., and also some $C_8$ paraffins and naphthenes.

When FCC catalyst was used, the conversion of benzene was greater when the reaction occurred at 220° C.

and transalkylation took place. When zeolite beta was used, a shorter reaction time resulted in a higher rate of benzene and toluene conversion.

EXAMPLE 5

Benzene-rich reformate distillate in an amount of 752.9 g /hr and propylene at the rate of 34.4 g /hr were fed into a CSTR reactor containing 24 g Octidyne 1170 (Engelhard Corp.). The reactants were heated to 185° C. and brought to a pressure of 300 psig to effect alkylation. The residence time in the CSTR was 1.5 hours. Heat treatment then followed at 220° C. and a pressure of 400 psig for a time of 2 hours. The composition of the reactor feed and effluent streams, the octane numbers of the reactants and products, and the overall percent conversion of benzene in the effluents from the reactor and heat treatment unit, are shown in Table 5.

TABLE 5

Content in grams of Selected Hydrocarbons and Octane Numbers of Reactor Feed, Reactor Effluent, and Heat Treatment Unit Effluent, Using FCC Catalyst

| | Reactor Feed | | | Heat |
|---|---|---|---|---|
| | Reformate Distillate | Olefin | Reactor Effluent | Treatment Unit Effluent |
| $C_3$ | | 34.4 | 1.1 | 0.6 |
| Lights | 144.4 | | 146.7 | 149.2 |
| Benzene | 39.5 | | 16.3 | 10.4 |
| Intermediate Fraction | 33.7 | | 34.1 | 34.3 |
| Toluene | 29.2 | | 10.4 | 13.5 |
| Heavy paraffin | 0.3 | | 0.3 | 0.6 |
| Ethylbenyene | | | — | 0.3 |
| m- and p- xylene | | | 0.3 | 0.6 |
| o- xylene | | | — | 0.3 |
| >o-xylene | | | — | 0.0 |
| $C_9$ aromatics | | | 20.3 | 28.1 |
| $C_{10}$ aromatics | | | 20.0 | 17.7 |
| $C_{11}$ aromatics | | | 0.6 | 1.1 |
| $C_{12}$ aromatics | | | 20.3 | 19.1 |
| $C_{13}$ aromatics | | | 11.3 | 5.6 |
| Octane No. | | | | |
| MON | 73.0 | | 80.3 | 80.6 |
| RON | 75.5 | | 81.1 | 82.4 |
| % conversion of benzene | | | 58.7 | 73.7 |

The degree of conversion of benzene was relatively high before and after transalkylation. The alkylation process resulted in a substantial increase in the octane rating of the hydrocarbon mixture, and heat treatment caused the octane rating of the mixture to increase even further.

As will be apparent to persons skilled in the art, various modifications and adaptations of the embodiments of the invention which are described above will become readily apparent without departure from the spirit and scope of the invention, the scope of which is defined in the appended claims.

What is claimed is:

1. A process for reducing the quantity of benzenes and n-paraffins present in a hydrocarbon mixture, comprising contacting the hydrocarbon mixture with a zeolite catalyst selected from the group consisting of zeolites having ten membered ring-type structures and zeolites having twelve membered ring-type structures, at conditions of temperature and pressure appropriate to crack n-paraffins to produce olefins and lower molecular weight n-paraffins, to induce reaction of olefins with benzene to form alkylbenzenes, and to promote isomerization of the n-paraffins to produce i-paraffins.

2. A process according to claim 1, wherein the alkylbenzenes include at least one of dialkylbenzenes and trialkylbenzenes, the process further comprising the step of contacting the alkylbenzenes with a transalkylation catalyst in order to convert the at least one of dialkylbenzenes and trialkylbenzenes to monoalkylbenzenes.

3. A process according to claim 2, wherein the transalkylation catalyst comprises a zeolite.

4. A process according to claim 3, wherein the transalkylation catalyst is selected from the group consisting of zeolites having ten membered ring-type structures and zeolites having twelve membered ring-type structures.

5. A process according to claim 1, further comprising the step of adding olefin to the hydrocarbon mixture to alkylate benzene.

6. A process according to claim 2, further comprising the step of adding olefin to the hydrocarbon mixture to alkylate benzene.

7. A process according to claim 1, wherein the zeolite is selected from the group consisting of type Y, faujasite, zeolite omega, ZSM-12, zeolite beta, and zeolite containing FCC catalysts.

8. A process according to claim 3, wherein the transalkylation catalyst is selected from the group consisting of type Y, faujasite, zeolite omega, ZSM-12, zeolite beta, and zeolite containing FCC catalysts.

9. A process according to claim 2, wherein alkylation, cracking, isomerization and transalkylation occur in a single reaction zone.

10. A process according to claim 8, wherein alkylation, cracking, transalkylation and isomerization occur in a single reaction zone.

11. A process according to claim 5, wherein the olefin is at least one of propylene and ethylene.

12. A process according to claim 6, wherein the olefin is at least one of propylene and ethylene.

13. A process according to claim 1, wherein reaction occurs at a temperature of about 200°-600° F. and a pressure of about 50-1000 p.s.i.g.

14. A process according to claim 5, wherein 1 mole of olefin is added for every 0.5-10 moles of the combination of benzene and toluene.

15. A process according to claim 1, wherein the amount of catalyst is about 0.1-20 wt % based upon the total weight of reactants.

16. A process for reducing the quantity of benzenes and n-paraffins present in a hydrocarbon mixture, comprising the steps of:

contacting the hydrocarbon mixture with an appropriate concentration of a FCC catalyst in a first reactor vessel at conditions of temperature and pressure sufficient to crack n-paraffins to produce olefins and lower molecular weight n-paraffins, and to induce reaction of olefins with benzene to form alkylbenzenes, and regenerating the catalyst as required in a regenerator which is shared with a second reactor vessel, the second reactor vessel being a catalytic cracking vessel.

17. A process according to claim 16, further comprising the step of isomerizing n-paraffins to produce i-paraffins in the presence of an isomerization catalyst.

18. A process according to claim 16, wherein the alkylbenzenes include at least one of dialkylbenzene and trialkylbenzenes, the process further comprising the step of contacting the alkylbenzenes with a transalkylation catalyst in order to convert the at least one of dialkylbenzenes and trialkylbenzenes to monoalkylbenzenes.

19. A process according to claim 17, wherein the isomerization catalyst comprises a zeolite.

20. A process according to claim 18, wherein the transalkylation catalyst comprises a zeolite.

21. A process according to claim 20, wherein the transalkylation catalyst is selected from the group consisting of zeolites having ten membered ring-type structures and zeolites having twelve membered ring-type structures.

22. A process according to claim 16, further comprising the step of adding olefin to the hydrocarbon mixture to alkylate benzene.

23. A process according to claim 17, further comprising the step of adding olefin to the hydrocarbon mixture to alkylate benzene.

24. A process according to claim 18, further comprising the step of adding olefin to the hydrocarbon mixture to alkylate benzene.

25. A process according to claim 16, wherein the zeolite is selected from the group consisting of type Y, faujasite, zeolite omega, ZSM-12, zeolite beta, and FCC catalysts containing zeolite Y.

26. A process according to claim 22, wherein the olefin is at least one of propylene and ethylene.

27. A process according to claim 1, wherein the zeolite catalyst is a FCC catalyst.

* * * * *